United States Patent [19]

Escalera

[11] 4,325,821

[45] Apr. 20, 1982

[54] AMINE OXIDE PROMOTERS FOR FROTH FLOTATION OF MINERAL ORES

[75] Inventor: Saul J. Escalera, Dublin, Ohio

[73] Assignee: Sherex Chemical Company, Inc., Dublin, Ohio

[21] Appl. No.: 231,286

[22] Filed: Feb. 4, 1981

Related U.S. Application Data

[63] Continuation-in-part of Ser. No. 66,637, Aug. 15, 1979, abandoned.

[51] Int. Cl.[3] ..... B03D 1/02

[52] U.S. Cl. ..... 209/166; 252/61; 210/704

[58] Field of Search ..... 209/166, 167; 252/61; 364/297; 210/704

[56] References Cited

U.S. PATENT DOCUMENTS

| | | | |
|---|---|---|---|
| 2,060,568 | 12/1944 | Graenacher | 346/184 X |
| 2,159,967 | 5/1939 | Engelmann | 209/166 X |
| 2,364,520 | 12/1944 | Cole | 209/166 |
| 2,937,751 | 5/1960 | Schoeld | 209/166 |
| 3,032,198 | 5/1962 | Neen | 209/167 |
| 3,073,448 | 1/1963 | McCorkle | 209/166 |
| 3,114,704 | 12/1963 | Kauffman | 252/61 |
| 3,200,512 | 9/1965 | Koebner | 564/299 |
| 3,202,714 | 8/1965 | Zimmerer | 564/297 |
| 3,265,211 | 8/1966 | Ray | 252/61 X |
| 3,449,430 | 6/1969 | Dohr | 564/297 |
| 3,449,431 | 6/1969 | Swenson | 564/297 |
| 3,450,637 | 6/1969 | Drew | 504/297 |
| 3,499,930 | 3/1970 | Wakeman | 564/297 |
| 3,596,763 | 8/1971 | Berthon | 252/61 |
| 3,891,544 | 6/1975 | Beckel | 209/166 |
| 4,113,631 | 9/1978 | Thompson | 252/8.55 C |

FOREIGN PATENT DOCUMENTS

| | | | |
|---|---|---|---|
| 1068191 | 11/1959 | Fed. Rep. of Germany | 209/166 |

OTHER PUBLICATIONS

Chem. Abst., 90, 1979, 124362x, p. 124376.
Chem. Abst., 70, 1969, 98866c, p. 98665.
Chem. Abst., 70, 1969, 13058v, p. 13069.
Chem. Abst., 77, 1972, 77091c, p. 77093.
Chem. Abst., 88, 1978, 107617a, p. 107633.

*Primary Examiner*—Robert Halper
*Attorney, Agent, or Firm*—Mueller and Smith

[57] ABSTRACT

Disclosed is an improved froth flotation process wherein preselected solid particles are selectively separated under froth flotation conditions as a froth phase from remaining solid feed particles as an aqueous phase in the presence of a collector amine. Such improvement comprises conducting said froth flotation in the presence of an effective proportion of an amine oxide promoter. The preferred feed particles comprise sylvinite ore.

22 Claims, No Drawings

AMINE OXIDE PROMOTERS FOR FROTH FLOTATION OF MINERAL ORES

CROSS-REFERENCE TO RELATED APPLICATIONS

This application is a continuation-in-part of application U.S. Ser. No. 66,637, now abandoned filed Aug. 15, 1979, the disclosure of which is expressly incorporated herein by reference.

BACKGROUND OF THE INVENTION

The present invention relates to the froth flotation of mineral ores and more particularly to a unique amine oxide promoter useful in the froth flotation of potash and other mineral ores.

It is common practice in froth flotation to utilize a chemical collector which is selectively adsorbed on the surface of the particles to be collected in order to enhance the concentration of such particles in one phase (usually the froth phase) while leaving remaining particles in the other phase (usually the aqueous phase). For example, in the flotation of sylvite (KCl) from sylvinite ores (potash ores) the chemical collectors which predominate in commercial practice are relatively long (greater than $C_{16}$) straight chain primary aliphatic (e.g. tallow) amines. Such amine collectors are selectively adsorbed on the surface of the sylvite particles which enhances the concentration of such sylvite particles in the froth phase during the flotation process.

Coarse ore particles of greater than 20 mesh on up to about 6 mesh (Tyler standard sieves series) are difficult to float in the froth phase and usually a nonpolar hydrocarbon oil must be used in combination with the amine collectors in order to even marginally float such coarse size ore particles. Still, recovery yields of below 50 percent by weight on the average is common in industrial froth flotation of such coarse size ore particles. Effective recovery of coarse size particles is difficult regardless of the composition of the particles and certainly is not restricted to the flotation of sylvinite ores.

BROAD STATEMENT OF THE INVENTION

The present invention is an improved froth flotation process wherein preselected particles not substantially larger than about 3.3 mm average particle size are selectively separated under froth flotation conditions as a froth phase from remaining feed particles as an aqueous phase in the presence of a collector amine. The improvement in such process is characterized by the addition of an effective proportion of an amine oxide promoter. The amine oxide promoter can be represented in conventional fashion by the following general structure:

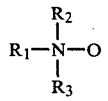

(I)

where, $R_1$, $R_2$, and $R_3$ are monovalent organic groups and advantageously, $R_1$ is a linear or branched, substituted or unsubstituted, saturated or unsaturated monovalent aliphatic, alicyclic, alicyclic-aliphatic, or aliphatic-aromatic group which may contain linkages of ether, amine, or sulfide, and $R_1$ has an effective chain length of about 1 to 30 atoms, and $R_2$ and $R_3$ each, independently, is a $C_1$–$C_{30}$ alkyl or alkanol group, or $R_2$ $R_3$ is a heterocyclic residue.

Advantages of the present invention include excellent recovery yields of coarse size particles in the forth flotation process and improved flotation kinetics of the particles for increased throughput of particles in the process. Another advantage is the ability of the amine oxide promoter to suppress the negative effect of the extender oil in the froth flotation process by stabilizing the froth to an abundant, yet manageable, layer which permits the coarse size particles to buoy more easily. Further advantages include the amine oxide promoter's presence in the process lowering the total proportion of collector amine required per unit weight of particles fred to the process and the ability to use collector amines of shorter chain length than heretofore could have been used in froth flotation processes.

DETAILED DESCRIPTION OF THE INVENTION

The present invention works effectively and efficiently with sylvinite ores for flotation of sylvite therefrom and will be described in detail in connection therewith, but such description should not be construed as a limitation of the invention. For example, the invention also works effectively and efficiently in the froth flotation of phosphate ores (cleaner float), titaniferous ores, glass sand and a variety of other mineral ores. Thus, the use of the amine oxide promoters of the present invention is limited only by the abilty of conventional amines to effectively enhance the froth flotation of the particles. Hence, the present invention should be construed broadly relative to suitable feeds for the flotation process.

Extensive testing conducted during the course of developing the present invention revealed that amine oxides effectively improve a cationic flotation process. While the particular substituents attached to the amine oxide nucleus (the nitrogen-oxygen coordinate covalent group) do impact the activity of the amine oxide promoter in the process, such impact generally is less in magnitude than the impact which the mere presence of any amine oxide displays in the flotation process. This would indicate that the amine oxide nucleus is the active species in the process, though admittedly this is yet to be finally confirmed. Further, while the electronic configuration of the amine oxide or other unique property may be responsible for its intense effect in the flotation process, this too is not yet confirmed, but is hypothesis. It has been determined, however, that the amine oxide alone, i.e. with no amine collector, in the flotation process is inadequate as a collector. Thus, the amine oxide does promote or enchance the collector amine in the flotation process and is not solely responsible for the remarkable flotation results yielded by the present invention. About the only real limitation uncovered for the amine oxide promoters of the present invention is that they must be adequately dispersible or soluble in the flotation or conditioning solvent, almost always water, in order to promote the float. Methods for achieving such dispersibility will be discussed later herein.

The only other limitation on the amine oxide promoters arises from their synthesis in that certain substituents give rise to steric and electronic hindrance, as those skilled in this art are aware. Still, a plethora of amine oxide promoters can be easily and efficiently synthesized and have been determined to be effective in the flotation process. The amine oxide promoters suitable for use in the present invention can be represented in conventional fashion by the following general structure:

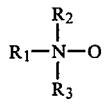

(I)

where $R_1$, $R_2$, and $R_3$ are monovalent organic groups which are reactable with an amine (e.g. primary or secondary amine) to form a tertiary amine (e.g. such groups can alkylate, alkoxylate, etc. an amine) which tertiary amine then can be oxidized to form the amine oxide promoter. Boradly, $R_1$ can be a linear or branched, substituted or unsubstituted, saturated or unsaturated, monovalent aliphatic, alicyclic, alicyclic-aliphatic, or aliphatic-aromatic group which may contain linkages of ether, amine, amide, or sulfide. $R_1$ will have an effective chain length of between about 1 and 30 atoms and advantageously about 6 and 22 atoms. The $R_2$ and $R_3$ groups generally will be the same for obvious ease in synthesis of the amine oxides, though such chemical structure identity is not a limitation of the invention. Broadly, $R_2$ and $R_3$ will be a $C_1$–$C_{30}$ aliphatic group, optionally, optionally substituted (e.g. with hydroxyl or armoatic groups) and optionally containing linkages of ether, sulfide, and the like. Advantageous $R_2$ and $R_3$ groups are $C_1$–$C_{30}$ alkyl or alkanol groups and preferably $C_1$–$C_4$ alkyl or alkanol groups. Further, $R_2$ and $R_3$ can be polyoxyalkylene groups. $R_2R_3$ additionally can be a heterocyclic residue, e.g. of piperidine, morpholine, or the like. Presently preferred $R_1$ groups are $C_6$–$C_{22}$ alkyl, alkoxy-alkyl, and aminoalkyl groups. Presently preferred $R_2$, $R_3$ groups are $C_1$–$C_3$ alkyl groups and $C_2$–$C_3$ 2-hydroxyalkyl groups.

Tertiary amine equivalents (heterocyclic, acylic, etc.) also can be oxidized to form amine oxides. Thus, tertiary amines and equivalents thereof for present purposes comprise a nitrogen atom in a molecule wherein no protons are attached to the nitrogen atom. Amine oxides of such tertiary amine equivalents can be represented as follows:

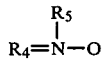

(II)

where $R_4$ and $R_5$ are organic groups including $R_4R_5$ being a heterocyclic residue. $R_4$ and $R_5$ each advantageously can be a $C_1$–$C_{30}$ aliphatic group. Examples of such tertiary amine equivalents useful in the present invention include for example, pyridine, pyrazole, imidazolines, picolines, and the like.

Representative amine oxide promoters for use in the present invention include, for example, those amine oxides with the following substitutents from structure I:

| $R_1$ | $R_2$ and $R_3$ |
|---|---|
| $CH_3-(CH_2)_{11}-$ (lauryl group) | $-CH_3$ |
| $CH_3-(CH_2)_{11-14}-O-(CH_2)_3-$ | $-CH_2-CH(OH)-CH_2$ |

-continued

| $R_1$ | $R_2$ and $R_3$ |
|---|---|
| $CH_3-(CH_2)_{11-14}-O-(CH_2)_3-$ | $-CH_2-CH(OH)-CH_2-O-C(CH_3)_2-CH_3$ |
| $CH_3-(CH_2)_{11-14}-O-(CH_2)_3-$ | $-CH_2-CH(OH)-CH_2-CH_3$ |
| $CH_3-(CH_2)_7-O-(CH_2)_3-$ | $-CH_2-CH(OH)-CH_2-CH_3$ |
| $CH_3-(CH_2)_{11-14}-O-(CH_2)_3-$ | $-CH_2-CH(OH)-C_6H_5$ |

Note that some of the above amine oxides are the novel anhydrous amine oxides of Earl and Hickman disclosed in commonly assigned application U.S. Ser. No. 106,746, filed on Dec. 26, 1979, now U.S. Pat. No. 4,275,236 which anhydrous amine oxides have been determined to function in the flotation process.

Synthesis of the amine oxide promoters is routine and generally involves the reaction of a suitable tertiary amine with a peroxidizing agent, preferably hydrogen peroxide, at temperatures of about 60° to 80° C. for forming the amine oxide. This synthesis may be carried out in aqueous solvent, in an alcohol solvent, or without solvent for those novel anhydrous amine oxides of Earl and Hickman, supra. Peracids also can be important reagents for this synthesis (see March, *Advanced Organic Chemistry*, 2nd Edition, page 1111, McGraw-Hill, Inc., New York, NY 1977). The nitrogen-oxygen linkage in the amine oxide is a coordinate covalent bond and such amine oxides can be amphoteric depending upon the pH. Whether such amphoteric property of the amine oxide is important in its effectiveness as a promoter for froth flotation is unknown and is not a limitation of the invention since the amine oxide promoters, in fact, are effective in froth flotation as disclosed by the present invention. Synthesis of the tertiary amines which can be converted to the amine oxide promoters is conventional and many of such tertiary amines can be purchased from commercial sources. The examples will detail some representative synthesis schemes for synthesizing the tertiary amines and their conversion to the amine oxide promoters. Certainly those skilled in the art will appreciate how such amine oxide promoters can be synthesized. The amine oxide promoters are used in an effective proportion for promoting the forth flotation process and generally such proportion ranges from about 0.0001 weight percent to about 0.025 weight percent based on the weight of the mineral ore being subjected to the froth flotation process. Use of too high of a proportion of the promoters may not promote the process and may even be deleterious.

The amine collectors (cationic amine collectors) which form a part of the amine collector blend with the amine oxide promoters generally are those amine collectors conventionally used in mineral froth flotation processes, though specially prepared amine collectors (e.g. primary ether amines) may be used as is necessary, desirable, or convenient. More often, the promoting effect of the amine oxide is so great relative to the collector effect of the amine collectors that the particular type of amine collector used is of less importance in the process. Conventional amine collectors are long straight chain (for example, $C_{16}$–$C_{22}$) primary aliphatic amines, such as, for example, tallow amines. Such amine collectors are widely used in sylvite flotation from sylvinite ores. Such amine collectors generally are synthesized from corresponding fatty acids wich can be vegetable oil fatty acids, tall oil fatty acids, fatty acids derived from animal fat, marine oils, and synthetic fatty acids and combinations of such fatty acids.

Common practice in this froth flotation field involves the blending of various amine collectors for use in the froth flotation process. Generally, such conventional amine collectors will contain mixtures of amines whose carbon chain length is $C_{16}$, $C_{18}$,$C_{20}$, and $C_{22}$. The precise proportion of the particular indicated chain length amine collectors heretofore has been based upon the effectivenss of the collector in the froth flotation process to a degree and more importantly upon the temperature of the flotation bath. For example, when the flotation bath is at a temperature of around 30° to 35° C., which condition often is reached during the summer, the amine collector blend typically will contain about 75 to 80 percent $C_{20}$ and $C_{22}$ amines with the balance being $C_{14}$, $C_{16}$, and $C_{18}$ amines. When the bath temperature is relatively low, say about 20° to 25° C. which can be a typical winter temperature, the amine collector generally comprises about 50 percent $C_{20}$ and $C_{22}$ amines with the balance being a mixture of $C_{14}$, $C_{16}$, and $C_{18}$ amines. A decisive advantage of the present invention is that the particular amine collector blend need not be reformulated according to the temperature of the flotation bath because the amine oxide promoters are so effective in the process that virtually any composition of amine collector can be used at any froth flotation bath temperature practiced.

Other chemicals which are conventionally added in the conditioning step include non-polar hydrocarbon oils which enhance the beneficial effect of the collector amines and conventional frothers or frothing agents. Tyical non-polar hydrocarbon oils include synthetic coal oil, fuel oil, and various petroleum oils. Most frothing agents are alcohols such as pine oil, methyl isobutyl carbinol and the like. As will be demonstrated in the examples, an alcohol solvent for the amine oxide can effectively replace the frother as well as disperse or solvate the amine oxide. The non-polar hydrocarbon oils and frothing agents for the present invention are conventional in composition and in proportions used. Optionally, a slime depressant can be added to the bath in conventional fashion or an auxiliary reagent such as a pasted starch (U.S. Pat. No. 3,456,790) may be added also.

The amine oxide promoted collector system of the present invention broadly can have a weight ratio of amine oxide to amine collector of about 1:500 to about 1:0.4. The amount of amine collector used in the total system may be less than is conventionally used in froth flotation processes which employ aliphatic and similar amines alone as the collector. Additionally, the intensity of the amine oxide promoters in the process is sufficient to permit the use of shorter chain aliphatic amines in the system and still provide a substantial improvement in the froth flotation process. Accordingly, significant $C_8$, $C_{10}$, $C_{12}$, and $C_{14}$ primary aliphatic amines can be used in the amine collector blend of the present invention as well as the predominantly used $C_{16}$–$C_{22}$ aliphatic amines. Heretofore, the use of substantial proportions of $C_{12}$, $C_{14}$ and shorter chain aliphatic amines as collectors in froth flotation processes was not possible. Also, the amine oxide substantially diminishes the adverse effect which the extender oil has on the stability of the froth in the process, as will be demonstrated in the examples which follow.

In order to convert the amine collector into a practical form for use in a froth flotation process, such amine is neutralized (acidulated) with a proton donating acid. Such neutralization is necessary because most aliphatic amine collectors are solid at room temperature. About a 60%-70% minimum neutralization is required in order to stabily disperse the collector amine in water, though in excess of 100% neutralization can be practiced at the expense of extra acid. Suitable (protic) acids for neutralizing (forming an acid salt) the blend include mineral acids such as, for example, HCl, $H_2SO_4$ and the like; organic acids such as, for example, acetic acid, propionic acid, formic acid, lactic acid and the like; and mixtures thereof. The amine oxide promoter need only be dispersible as a liquid or soluble in an aqueous bath in order to be in proper form for use in the flotation process. Thus, the promoter often will be in solvent for admission to the flotation process, conveniently at a 10%–30% actives (non-volatile solids) concentration. Suitable solvents may be water, alcohol, and the like and mixtures thereof. Protonation of the amine oxide for dispersibility in water may be practiced as is necessary, desirable, or convenient. In this context, an amine oxide which could not be dispersed or solubilized in water with acid or in isobutoxy-2-propanol was hexyl-bis(2-hydroxyhexadecyl) amine oxide (see Example VI of the Earl and Hickman application, supra). Such amine oxide is believed capable of functioning as a promoter in the flotation process, though extensive solubilizing studies of it have not been undertaken. Generally a 10% –60% non-volatile solids concentration of the amine collector and amine oxide is used, though higher solids concentrations may be preferred if practical viscosities can be maintained.

In practicing the present invention, the mineral ore to be subjected to the froth flotation process typically is comminuted or attrited, though certain beach sand size ores may by-pass this step. Typically, the ore should be in a size not substantially greater than about 6 mesh (Tyler sieve series and corresponding to about 3.3 mm). Significantly larger particles generally are impossible to effectively buoy in the froth. There is no real lower size restriction on the ore fed to the process. It should be noted that the present invention makes recovery of the coarse ore fraction ranging in size from about 6 to 20 mesh (about 1 to 3.3 mm) in exceptionally good yields. Preferred feed for the process includes potash or sylvinite ore, phosphate ore (finer float), glass-grade sand and the like, though the amine collector blend of the present invention can be used effectively on any particle which is susceptible to selective flotation using conventional amine collectors.

Often, the ore requires desliming in order to remove clays and other insoluble material. For example, potash ores typically contain sylvite, sodium chloride, and about 1 to 7 percent by weight insoluble clay materials. Desliming conventionally is practiced by dispersisng the ore in saturated brine containing a dispersant (such as sodium metasilicate, for example) with continual washing of the ore with saturated brine until a significant proportion of the original slimes are removed. Additionally, a slime depressant can be added during the conditioning stage of the process. Next, most ores are conditioned by the addition of the amine collector and amine oxide promoter, optionally containing the extender oil and slime depressant also. Stepwise conditioning with the indivdual chemical additives may be practiced also. Conditioning times for most ores generally ranges from about 1 to 5 minutes or thereabouts. It should be noted that in sylvite flotation from sylvinite ore, all steps of the process utilize a saturated brine as the aqueous phase in order to prevent the sylvinite from dissolving in the water. Preferably, such brine contains dissolved sylvite in water, though other salts could be used to form the brine.

The conditioned ore then is admitted to a conventional flotation cell in a proportion of about 15 to 30 percent ore solids by weight at a flotation temperature often ranging from about 15° to 40° C. The conditioned ore concentrate preferably already contains the amine collector, amine oxide promoter, and other chemicals desirably added as described above. The frothing agent is added to the cell if not already present in the conditioning bath (e.g. from use of the amine oxide dispersed in alcohol), and flotation proceeds under froth flotation conditions in conventional fashion. Froth flotation conditions for present purposes comprehends the cell temperature, froth generating intensity, ore solids concentration in the flotation cell, composition of brine used, additives (for example, extender oil, slime depressant, frothing agent, and the like), and similar conventional factors. Flotation separation times can be as short as about 30 seconds with the novel amine collector blend on up to conventional times of about 2 to 3 minutes, of course depending upon the concentration of ore in the cell, the particular design of the cell utilized, and a variety of other factors well known to those artisans skilled in this art. It should be noted that the amine oxide improves the flotation kinetics of the particles being collected in the froth and, thus, can substantially increase the thoughput of ore in the flotation process. Also, recoveries in excess of 80 percent on the average of the coarser fraction of ore fed to the process can be realized with the present invention.

The following examples show how the present invention can be practiced, but should not be construed as limiting. In this application, all percentages and proportions are by weight, all temperatures are in degrees Centigrade, and all units are in the metric system, unless otherwise expressly indicated. Also, all references cited herein are expressly incorporated herein by reference.

EXAMPLES

In the examples, the following general flotation procedure was practiced. The sylvinite ore from the Saskatchewan Province in Canada was screened to isolate the −6 to +20 mesh fraction (Tyler standard sieves series). This coarse size ore fraction is difficult to effectively separate by froth flotation techniques due to the large particle size of such fraction. Samples of this ore fraction (250 gm per smaple) were deslimed in saturated brine (water saturated with KCL) containing 0.04% (by weight of the ore) sodium metasilicate dispersant (antiflocculant) and washed with saturated brine until about 50% of the slime content had been removed. Slimes mostly are insoluble clay minerals in sylvinite ores.

Each sample then was conditioned at about 60% solids for one minute in the presence of FINNFIX slime depressant (FINNFIX is a carboxymethyl cellulose product of Metsalliton Teollifuuf Oy-Chemical Division, Finland) and for another minute in the presence of Gulf Oil 904 extender oil (a non-polar petroleum-derived hydrocarbon oil, Gulf Oil Corporation, Pittsburgh, Pa.) Next, the chosen aliphatic amine (HCl neutralized aqueous dispersion of the amine) was added and permitted to condition with the ore pulp for one minute. Finally, the amine oxide promoter (HCl neutralized aqueous dispersion of the promoter) was added and permitted to condition with the ore pulp for an additional one minute.

The conditioned and reagentized ore pulp then was transferred to a WEMCO laboratory flotation cell (Arthur G. McKee & Co., Cleveland, Ohio), diluted with additional saturated brine, and froth flotationed at 1,000 rpm for 3 minutes or less. The following froth flotation and conditioning conditions prevailed: brine temperature of 25° or 35° C., 0.002% by weight of the ore of methyl isobutyl carbinol frother, 0.009% by weight of the ore of FINNFIX slime depressant, 0.0075% by weight of the ore of Gulf Oil 904 extender, and 15% or 25% by weight ore pulp solids in the cell. The precise flotation temperature, ore pulp solids, and proportions of aliphatic amine and amine oxide will be detailed in each example.

The amine oxide promoter used in Examples I-VI was a dialkanol alkoxy-alkylene amine oxide (from Structure I, $R_1$ is an adduct of the cyanoethylation and subsequent hydrogenation of a $C_{12}$–$C_{15}$ primary alcohol, $R_2$ and $R_3$ each are hydroxyethyl groups) designated as VAROX 185-E (VAROX is a trademark of Sherex Chemical Company, Dublin, Ohio). The aliphatic amine collector was a blend of ADOGEN 101-D amine (hydrogenated aliphatic amine having carbon chains of about 10% $C_{16}$, 20% $C_{18}$, 30% $C_{20}$, and 40% $C_{22}$) and ADOGEN 140 amine (hydrogenated tallow amine having carbon chains of about 5% $C_{14}$, 30% $C_{16}$, and 65% $C_{18}$ (ADOGEN is a registered trademark of Sherex Chemical Company, Dublin, Ohio). The proportions of each amine collector in the blends and the proportions of the blends and amine oxide promoter will be detailed in each example.

EXAMPLE I

The VAROX 185-E amine oxide was prepared by the dropwise addition under gentle agitation of 20.2 gms (0.297 moles or 1.1 equivalents) of a 50% aqueous hydrogen peroxide solution to 100 gms (0.270 mole) of ADOGEN 185 ethoxylated tertiary amine and 141.6 gms of deionized water held at 60° C. ADOGEN 185 amine is a mixture of amines (99.4% tertiary amine content) and can be represented by the following general structure:

$$C_{12\text{-}15}H_{25\text{-}31}O\text{-}(CH_2)_3\text{-}N\text{-}(CH_2\text{-}CH_2\text{-}OH)_2.$$

The peroxide addition required 20 minutes. After the reaction mixture went through a gel stage for 2 hours, the mixture was allowed to react for another 4 hours. A reaction temperature of 60°–80° C. was maintained by cooling of the reaction vessel. The final amine oxide product analyzed 41.7% amine oxide and 0.5% unoxidized tertiary amine.

EXMAPLE II

In this example, the brine temperature was 35° C. and the ore pulp solids in the flotation cell was 15% by weight. Three different aliphatic amine blends were used with and without the addition of the amine oxide promoter. In runs 1A and 1B the blend was 75% long chain amine (ADOGEN 101-D) and 25% tallow amine (ADOGEN 140); in runs 2A and 2B, 50% long chain amine and 50% tallow amine, and in runs 3A and 3B, 25% long chain amine and 75% tallow amine. The following results were obtained.

TABLE I

| Test No. | Amine Blend (wt. %) | Amine Oxide (wt %) | Sylvite (% as $K_2O$)* Froth | Tails | % Recovery Of Sylvite In Froth |
|---|---|---|---|---|---|
| 1A | 0.020 | 0 | 61.4 | 31.8 | 30 |
| 1B | 0.020 | 0.005 | 63.2 | 24.3 | 53 |
| 2A | 0.020 | 0 | 63.2 | 32.6 | 33 |
| 2B | 0.020 | 0.005 | 61.2 | 28.4 | 38 |
| 3A | 0.020 | 0 | 63.2 | 30.7 | 43 |
| 3B | 0.020 | 0.005 | 61.8 | 22.6 | 54 |

*Analyzed & Calculated for $K_2O$ in all examples (100% Sylvite = 63.2% $K_2O$).

The above-tabulated results clearly show that the recovery of sylvite from sylvinite ore is greatly enchanced by the addition of the amine oxide promoter even with aliphatic amine collectors of varying composition. Also, the proportion of amine oxide promoter required is relatively small (i.e. aliphatic amine to amine oxide weight ratio of 4:1).

EXAMPLE III

The procedure of EXAMPLE II was repeated except that the brine temperature was 25° C. The following results were obtained.

TABLE II

| Test No. | Amine Blend (wt %) | Amine Oxide (wt %) | Sylvite (% as $K_2O$) Froth | Tails | % Recovery Of Sylvite In Froth |
|---|---|---|---|---|---|
| 1A | 0.020 | 0 | 59.1 | 29.3 | 20 |
| 1B | 0.020 | 0.005 | 63.1 | 17.4 | 69 |
| 2A | 0.020 | 0 | 62.7 | 32.3 | 17 |
| 2B | 0.020 | 0.005 | 60.7 | 14.5 | 58 |
| 3A | 0.020 | 0 | 61.1 | 30.4 | 24 |
| 3B | 0.020 | 0.005 | 62.7 | 22.5 | 50 |

The above-tabulated results show the great impact which the amine oxide promoters have on the flotation process. In fact, the recoveries of sylvite are increased more with the amine oxide than without it at the 25° C. brine temperature than at the 35° C. brine temperature of EXAMPLE II. The same is true when using the promoter.

EXAMPLE IV

In this example the effect of higher ore pulp concentrations was investigated using the aliphatic amine blend of runs 3A and 3B of EXAMPLE II at 35° C. and the aliphatic amine blends of runs 2A and 2B of EXAMPLE III at 25° C. respectively. The following results were obtained.

TABLE III

| Run No. | Brine Temp (°C.) | Ore Pulp Solids (wt %) | Amine Blend (wt %) | Amine Oxide (wt %) | Sylvite (% as $K_2O$) Froth | Tails | % Recovery Of Sylvite In Froth |
|---|---|---|---|---|---|---|---|
| 1A | 35 | 15 | 0.020 | 0.005 | 62.1 | 17.8 | 48 |
| 1B | 35 | 25 | 0.020 | 0.005 | 60.6 | 6.5 | 84 |
| 2A | 25 | 15 | 0.020 | 0.005 | 63.2 | 25.9 | 42 |
| 2B | 25 | 25 | 0.020 | 0.005 | 62.3 | 5.7 | 87 |

The above-tabulated results show that the recovery of sylvite is greater at higher ore pulp solids at any brine temperature, and that lower brine temperature tend to increase the percentage of sylvite recovered. It must be remembered that the ore in these examples is the coarse fraction, yet recoveries of greater than 80% of such coarse fraction are shown in Runs 1B and 2B above. Such excellent recovery of coarse size ore clearly is shown to result from the presence of the amine oxide promoter in the process.

EXAMPLE V

The proportion of aliphatic amine collector in the previous examples is typical of present-day commercial sylvinite flotation processes. An advantage of the use of the amine oxide promoters is that the proportion of amine collector can be substantially lowered without adversely affecting the process. The following runs are substantially the same as EXAMPLE IV, except that the ore pulp solids was 25% in all runs and the proportion of amine collector was varied. The following results were obtained.

TABLE IV

| Run No. | Brine Temp (°C.) | Amine Blend (wt %) | Amine Oxide (wt %) | Sylvite (% as $K_2O$) Froth | Tails | % Recovery Of Sylvite In Froth |
|---|---|---|---|---|---|---|
| 1A | 35 | 0.020 | 0.005 | 60.6 | 6.5 | 84 |
| 1B | 35 | 0.012 | 0.005 | 60.4 | 5.1 | 87 |
| 2A | 25 | 0.020 | 0.005 | 60.5 | 7.2 | 85 |
| 2B | 25 | 0.012 | 0.005 | 62.0 | 6.2 | 87 |

The above-tabulated results clearly show that less amine collector can be used without any loss of sylvite recovery.

EXAMPLE VI

In this example, the sylvinite ore was from potash ore deposits in the Carlsbad, New Mexico, region. The amine collector was 100% of the hydrogenated tallow amine and the ore pulp solids was 25%. The following results were obtained

TABLE V

| Run No. | Brine Temp (°C.) | Amine Blend (wt %) | Amine Oxide (wt %) | Sylvite (% as $K_2O$) Froth | Tails | % Recovery Of Sylvite In Froth |
|---|---|---|---|---|---|---|
| 1A | 35 | 0.016 | 0 | 60.3 | 14.6 | 23 |
| 1B | 35 | 0.016 | 0.005 | 60.4 | 7.9 | 57 |
| 2A | 25 | 0.016 | 0 | 57.9 | 15.4 | 10 |
| 2B | 25 | 0.016 | 0.005 | 59.6 | 11.5 | 34 |

The increased sylvite recoveries by addition of an amine oxide are demonstrated by the above-tabulated results. Ores from different sources indigenously can contain differing impurities often in different proportions. Certainly, the source of the ore and impurities contained in each different source can affect the froth flotation process. This example demonstrates this. Yet, the amine oxide promoter clearly substantially improved the proportion of sylvite recovered in the process. Thus, tailoring the process and all of its variables is recommended for ores from different sources.

EXAMPLE VII

In this example, 500 gm samples of Saskatchewan Province potash ore (supplied by Cominco Potash Company, Saskatoon, Saskatchewan, Canada) was floated at 25° using an amine collector blend of 25% long chain amine (ADOGEN 101-D amine) and 75% talow amine (ADOGEN 140 amine). Three different amine oxides and a comparative run (Run No. 455) with only the frother were evaluated. The frother was MF- 142 which is believed to be distilled alcohol bottoms containing $C_6$, $C_8$, an $C_{10}$ alcohols (supplied by Canadian Industries, Ltd, Saskatoon, Saskatchewan, Canada). The amine oxides were supplied as a 10% actives aqueous solution (0.001 weight-% solution used in the float). The amine oxides evluatd were samples of the novel anhydrous amine oxides disclosed in commonly-assigned application of Earl and Hickman, U.S. Ser. No. 106,746, filed on Dec. 26, 1979, now U.S. Pat. No. 4,275,236 the disclosure of which is expressly incorporated herein by reference. Specifically, run no. 458 used the mine oxide of Example X, run no. 459 used the amine oxide of Example I, and run no. 460 used the amine oxide of Example V of said U.S. Patent No. 4,275,236. These amine oxides have the following composition:

STRUCTURE I

| RUN NO. | $R_1$ | $R_2$ and $R_3$ |
|---|---|---|
| 458 | $CH_3-(CH_2)_{11-14}-O-(CH_2)_3-$ | $-CH_2-CH(OH)-CH_2-O-C(CH_3)_2-CH_3$ |
| 459 | $CH_2-(CH_2)_{11-14}-O-(CH_2)_3-$ | $-CH_2-CH(OH)-CH_2-CH_3$ |
| 460 | $CH_3-(CH_2)_7-O-(CH_2)_3-$ | $-CH_2-CH(OH)-CH_2-CH_3$ |

The following flotation results were obtained:

TABLE VI

| Run No. | Amine Blend (wt-%) | Amine Oxide (wt-%) | Sylvite (% as $K_2O$) Froth | Sylvite (% as $K_2O$) Tails | % Recovery of Sylvite in Froth |
|---|---|---|---|---|---|
| 455 | 0.013 | — | 59.4 | 3.9 | 90 |
| 458 | 0.013 | 0.0001 | 58.8 | 1.6 | 96 |
| 459 | 01013 | 0.0001 | 59.6 | 2.8 | 94 |
| 460 | 0.013 | 0.0001 | 58.3 | 2.7 | 94 |

The above-tabulated results demonstrae the selectivity for sylvite flotation which is achieved by using the amine oxide promoters of the present invention. Note the small proporton of amine oxide promoter requied in the float. Note further that the proporton of collector mine has been lowered because of the amine oxide promoter's presence.

EXAMPLE VIII

The procedure of Example VII was repeated except that no MF-142 forther was used. Instead, the amine oxide promoters were dispersed in isobutoxy-2-propanol (10% amine oxide actives or solids by weight) which served as the frother. The amine oxide/alcohol blend was used in a proportion of 0.002 weight percent. The amine oxides evaluated, along with a comparative run using only isobutoxy-2-propanol as the frother (Run No. 464), were an amine oxide of the structure of VAROX 185-E amine oxide except that synthesis was in isobutoxy-2-propanol solvent instead of water (supplied by Sherex Chemical Company, Inc, Dublin, Ohio) (Run No. 463), the amine oxide used in run no. 459 of Example VII (Run No. 461), the amine oxide used in run no. 460 of Example VII (Run No. 462), and another amine oxide disclosed in Example XI of U.S. Pat. No. 4,275,236, represented by the following structure:

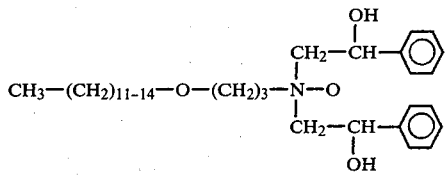

for Run No. 456.

The following flotation results were obtained:

TABLE VII

| Run No. | Amine Blend (wt-%) | Amine Oxide (wt-%) | Sylvite (% as $K_2O$) Froth | Sylvite (% as $K_2O$) Tails | % Recovery of Sylvite in Froth |
|---|---|---|---|---|---|
| 464 | 0.013 | — | 59.0 | 3.6 | 91 |
| 463 | 0.013 | 0.0002 | 60.3 | 2.1 | 95 |
| 456 | 0.013 | 0.0002 | 59.1 | 1.6 | 96 |
| 461 | 0.013 | 0.0002 | 59.3 | 1.9 | 95 |
| 462 | 0.013 | 0.0002 | 58.9 | 1.3 | 97 |

Again, a highly selective flotation is demonstrated even using an alcohol blend of the amine oxide promoter wherein the alcohol solvent effectively serves as the frother.

Based on the foregoing examples, it was determined that the presently preferred best mode of carrying out the present invention was to conduct the froth flotation on sylvinite (potash) ore at a temperature of 25°–35° C. at an ore solids concentration in the cell of 25–30% by weight using the VAROX 185-E amine oxide supplied in water or alcohol solvent at an actives proportion of about 0.005% by weight and the aliphatic amine blend of ADOGEN 101-D and ADOGEN 140 at a weight percentage ratio of 25:75, respectively, at a blend concentration of about 0.012% by weight. Preferably, the collector amine and amine oxide are neutralized with hydrochloric or the like acid, and the amine oxide is supplied in a range of 5% to 20% dispersion in water or alcohol solvent.

I claim:

1. In a froth flotation process where preselected solid particles are selectively separated under froth flotation conditions as a froth phase from remaining solid feed particles as an aqueous phase in the presence of a collector amine, the improvement characterized by the addition of an effective proportion of an amine oxide promoter.

2. The froth flotation process of claim 1 wherein the effective proportion of said amine oxide promoter is between about 0.0001% and 0.025% by weight of said feed particles.

3. The process of claim 1 wherein said preselected solid particles are not substantially larger than about 3.3 mm average particle size.

4. The process of claim 1 wherein said amine oxide promoter is represented by the following general structure:

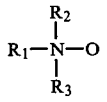

where, $R_1$, $R_2$, and $R_3$ are monovalent organic groups, or $R_1$ is a monovalent organic group and $R_2R_3$ is a heterocyclic residue; or $R_2$ and $R_3$ are the same group, R, joined by a double bond to said nitrogen atom wherein $R_1$ and R are organic groups or a heterocyclic residue.

5. The process of claim 4 wherein said amine oxide promoter is selected from the group consisting of amine oxides having the following substituents:

| $R_1$ | $R_2$ and $R_3$ |
|---|---|
| $CH_3-(CH_2)_{11}-$ | $-CH_3$ |
| $CH_3-(CH_2)_{11-14}O-(CH_2)_3-$ | $-CH_2-CH(OH)-CH_2$ |
| $CH_3-(CH_2)_{11-14}O-(CH_2)_3-$ | $-CH_2-CH(OH)-CH_2-O-C(CH_3)_2-CH_3$ |
| $CH_3-(CH_2)_{11-14}O-(CH_2)_3-$ | $-CH_2-CH(OH)-CH_2-CH_3$ |
| $CH_3-(CH_2)_7-O-(CH_2)_3-$ | $-CH_2-CH(OH)-CH_2-CH_3$ |
| $CH_3-(CH_2)_{11-14}O-(CH_2)_3-$ | $-CH_2-CH(OH)-C_6H_5$ |

6. The process of claim 4 wherein $R_1$ is a linear or branched, substitued or unsubstituted, saturated or unsaturated, monovalent aliphatic, alicyclic, alicyclicaliphatic, or aliphatic-aromatic group which may contain linkages of ether, amine, or sulfide, and $R_1$ has an effective chain length of about 1 to 30 atoms, and $R_2$ and $R_3$ each, independently, is a $C_1$–$C_{30}$ linear or branched, substituted or unsubstituted, saturated or unsaturated monovalent $C_1$–$C_{30}$ aliphatic group which may contain linkages of ether or sulfide, or $R_2R_3$ is a heterocyclic residue.

7. The process of claim 6 wherein $R_1$ is a $C_6$–$C_{20}$ alkyl, or aminoalkyl group.

8. The process of claim 6 or 7 where $R_2$ and $R_3$ each are a $C_1$–$C_3$ alkyl or alkanol group.

9. The process of claim 6 wherein $R_2R_3$ is a residue of a heterocyclic group selected from a piperidino group and a morpholino group.

10. The process of claim 1 wherein said feed articles comprise sylvinite ore.

11. The process of claim 1 wherein said feed particles are conditioned with said collector amine and said amine oxide prior to said flotation.

12. The process of claim 1 or 6 wherein said amine oxide promoter is provided in aqueous dispersion.

13. The process of claim 1 or 6 wherein said amine oxide promoter is provided dispersed in an alcohol solvent.

14. The process of claim 1 wherein the weight ratio of said collector amine to said amine oxide is between about 500:1 and 0.4:1.

15. The process of claim 1 wherein said froth flotation conditions include protonating said collector amine with a proton donating acid, a flotation temperature of between about 15° and 40° C., a concentration of particles of between about 15 and 30% by weight, and the addition of an alcohol frothing agent and/or a nonpolar hydrocarbon oil extender.

16. The process of claim 15 wherein said alcohol frothing agent is provided from an alcoholic dispersion of said amine oxide promoter.

17. The process of claim 1 wherein said collector amine is a $C_8$–$C_{22}$ primary aliphatic amine.

18. In the froth flotation process wherein preselected solid particles not substantially larger than about 3.3 mm average particle size are selectively separated under froth flotation conditions as a froth phase from remaining solid feed particles as an aqueous phase in the presence of a collector amine, the improvement characterized by conditioning said feed particles in an aqueous conditioning bath with said collector amine, a frothing agent, and an effective proportion of an amine oxide promoter and then subjecting said conditioned feed particles to said froth flotation, said amine oxide promoter represented by

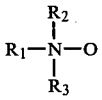

where, $R_1$ is an organic group having an effective chain length of about 1 to 22 atoms, and $R_2$ and $R_3$ each is a $C_1$–$C_4$ alkyl or alkanol group.

19. The process of claim 18 wherein $R_1$ is a $C_6$–$C_{22}$ alkyl, alkoxy-alkyl, or aminoakyl group; and $R_2$ and $R_3$ each is a $C_1$–$C_3$ alkyl or alkanol group.

20. The process of claim 18 wherein said amine oxide promoter is provided as an aqueous dispersion thereof.

21. The process of claim 18 wherein said amine oxide is provided in an alcohol solvent wherein said alcohol solvent is said frothing agent.

22. The process of claim 18 wherein said feed particles comprise sylvinite ore.

* * * * *